US006763540B1

(12) United States Patent
Wang

(10) Patent No.: US 6,763,540 B1
(45) Date of Patent: Jul. 20, 2004

(54) QUEEN SIZE AIR BED WITH A BAFFLE TO SEPARATE THE AIR BED INTO TWO PORTIONS

(76) Inventor: Cheng-Chung Wang, 12F, No. 440, Sec. 4, Jen-Ai Rd., Taipei (TW)

( * ) Notice: Subject to any disclaimer, the term of this patent is extended or adjusted under 35 U.S.C. 154(b) by 0 days.

(21) Appl. No.: 10/347,810

(22) Filed: Jan. 21, 2003

(51) Int. Cl.[7] ..... A47C 27/10
(52) U.S. Cl. ..... 5/710; 5/706; 5/711; 5/713
(58) Field of Search ..... 5/710, 711, 713, 5/727, 706

(56) References Cited

U.S. PATENT DOCUMENTS 4,394,784 A * 7/1983 Swenson et al. ..... 5/710
4,644,597 A * 2/1987 Walker ..... 5/711
5,740,573 A * 4/1998 Boyd ..... 5/711
5,852,839 A * 12/1998 Gancy ..... 5/706
6,058,537 A * 5/2000 Larson ..... 5/710
6,131,219 A * 10/2000 Roberts ..... 5/644
6,397,419 B1 * 6/2002 Mechache ..... 5/722
6,463,610 B1 * 10/2002 Shulte et al. ..... 5/712
6,543,073 B2 * 4/2003 Wu ..... 5/713

* cited by examiner

*Primary Examiner*—Teri Pham Luu
(74) *Attorney, Agent, or Firm*—Jackson Walker LLP

(57) ABSTRACT

An air bed has a hollow body. A baffle is adapted to be provided inside the hollow body to separate the body into a first chamber and a second chamber. The baffle is adapted to engage with inner surfaces of opposite sides of the body of the air bed.

6 Claims, 7 Drawing Sheets

QUEEN SIZE AIR BED WITH A BAFFLE TO SEPARATE THE AIR BED INTO TWO PORTIONS

BACKGROUND OF THE INVENTION

1. Field of the Invention

The present invention relates to a queen size air bed, and more particularly to a queen size air bed with a baffle securely received in the air bed to separate the air bed into two portions so that influence caused by vibration in one portion and transmitting to the other portion is minimized.

2. Description of Related Art

With reference to FIG. 1, a conventional air bed (9) is shown. The air bed (9) is made of plastic or the like. When the air bed (9) is in use, air is pumped into the air bed (9). When the air bed (9) is not in use, the operator is able to discharge the air inside the air bed (9) to deflate the air bed (9) so that the air bed (9) is able to be stored in a compact space.

The air bed (9), no matter the size, is easily influenced by any kind of vibration in any portion of the air bed (9). That is, if one person sleeping on one side of the air bed (9) turns or gets up in the middle of the night, no matter how carefully the person moves, the slightest vibration transmits easily to every portion of the air bed (9), such that if there is another person sleeping on the air bed (9), the vibration becomes disturbing.

To overcome the shortcomings, the present invention tends to provide an improved air bed to mitigate and obviate the aforementioned problems.

SUMMARY OF THE INVENTION

The primary objective of the present invention is to provide an improved air bed with a baffle in the air bed so that influence caused by vibration on one side of the air bed to the other side of the air bed is minimized.

Other objects, advantages and novel features of the invention will become more apparent from the following detailed description when taken in conjunction with the accompanying drawings.

DETAILED DESCRIPTION OF THE PREFERRED EMBODIMENT

Figure 1:
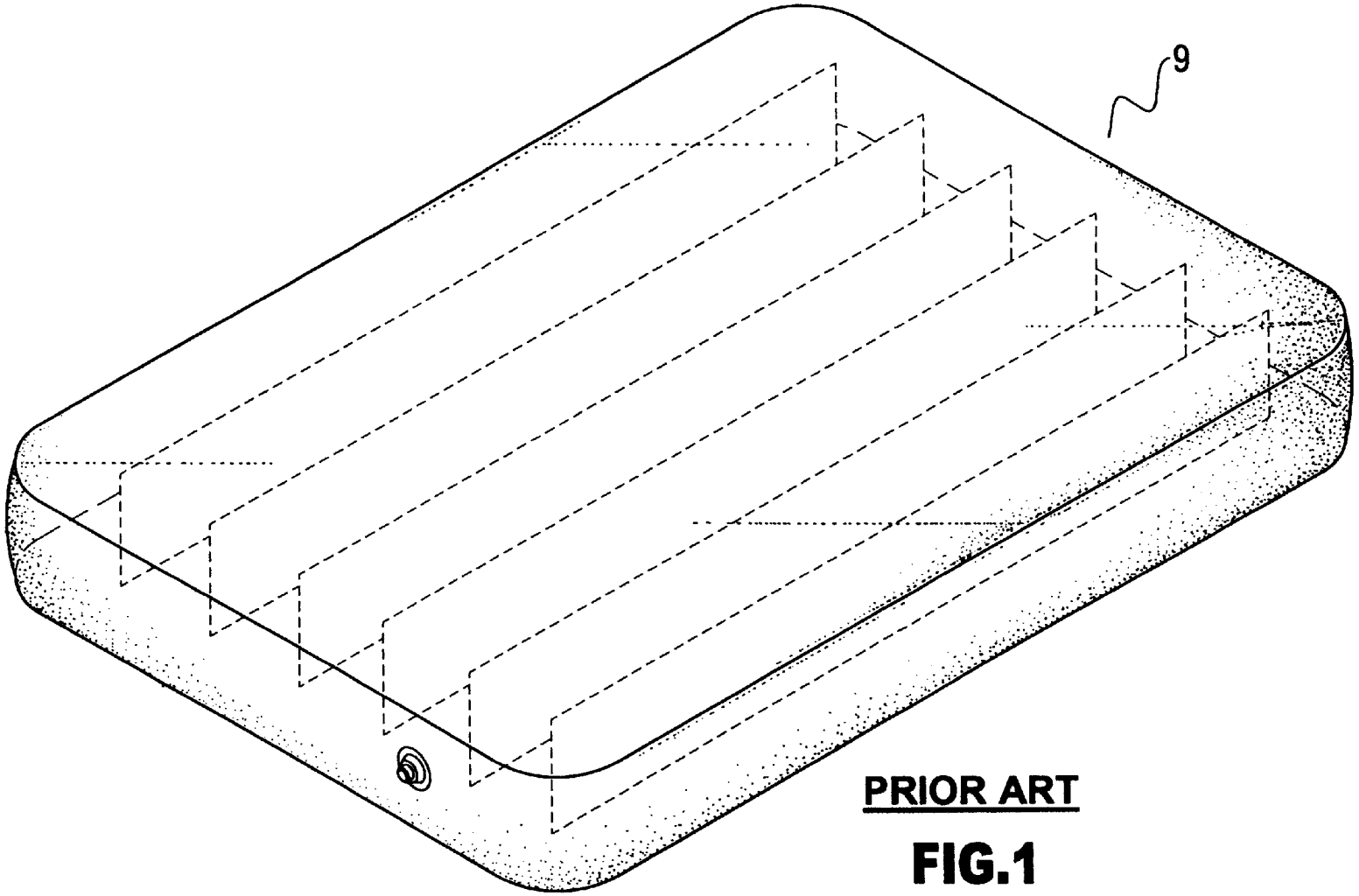
PRIOR ART FIG.1
FIG. 1 is a structural schematic view of a conventional view of the conventional air bed.
Figure 2:
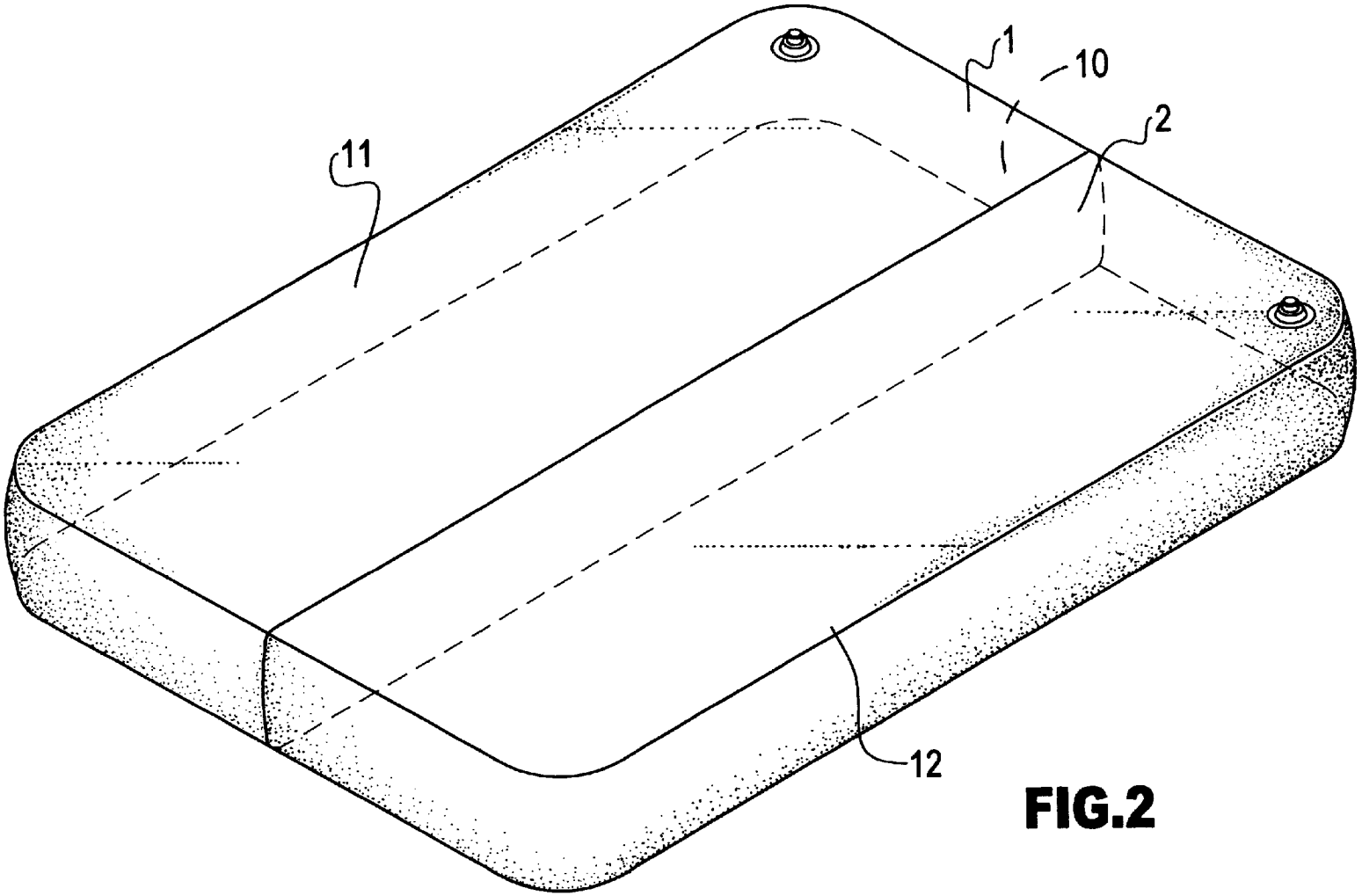
FIG. 2 is a structural schematic view of the air bed of the present invention.

With reference to FIG. 2, the air bed (1) in accordance with the present invention includes a baffle (2) inside a hollow body (10) of the air bed (1) to separate the body (10) into a first chamber (11) and a second chamber (12). The baffle (2) engages with inner surfaces of two opposite sides of the air bed (1).

Figure 3:
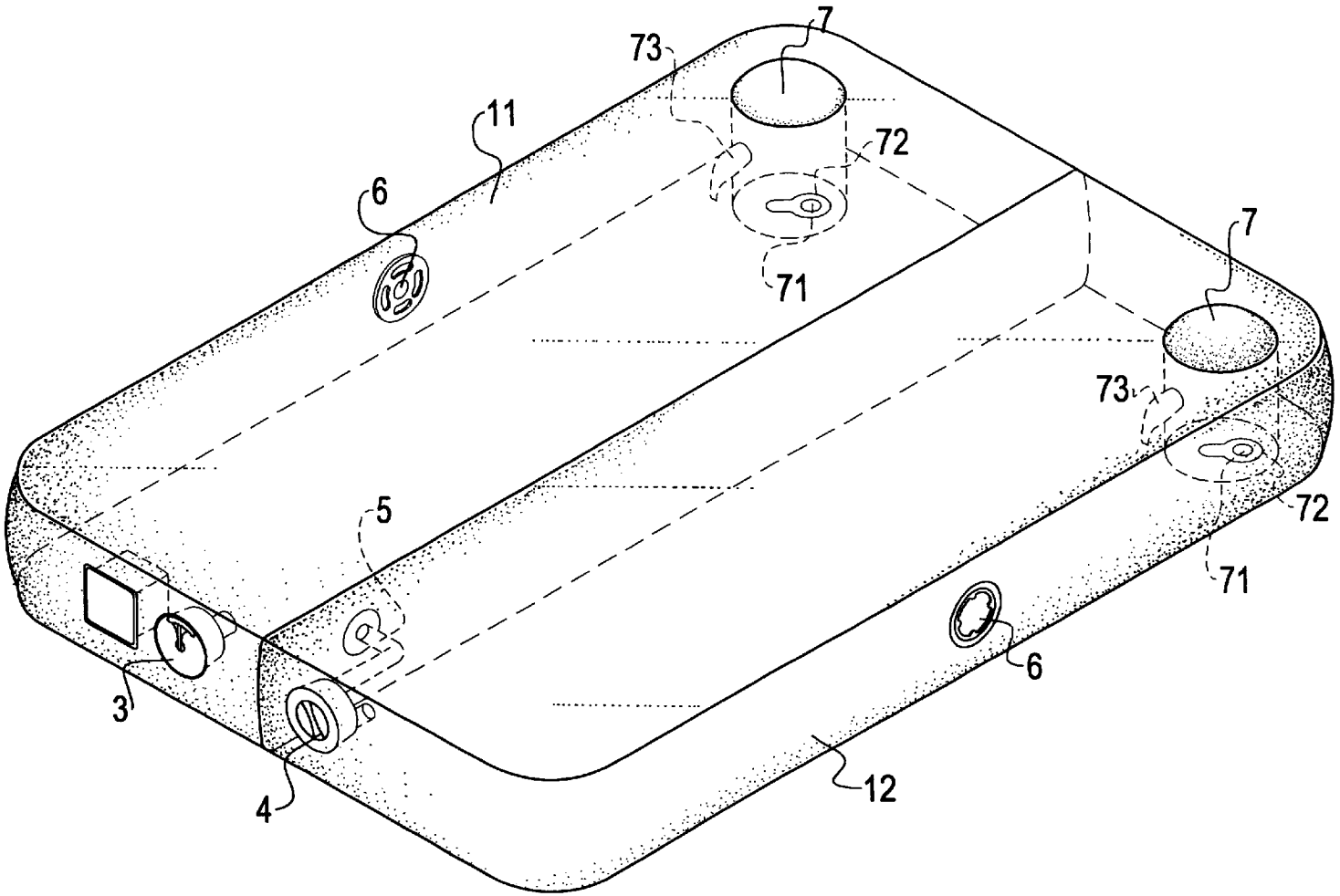
FIG. 3 is another structural schematic view of the air bed of the present invention.
Figure 4:
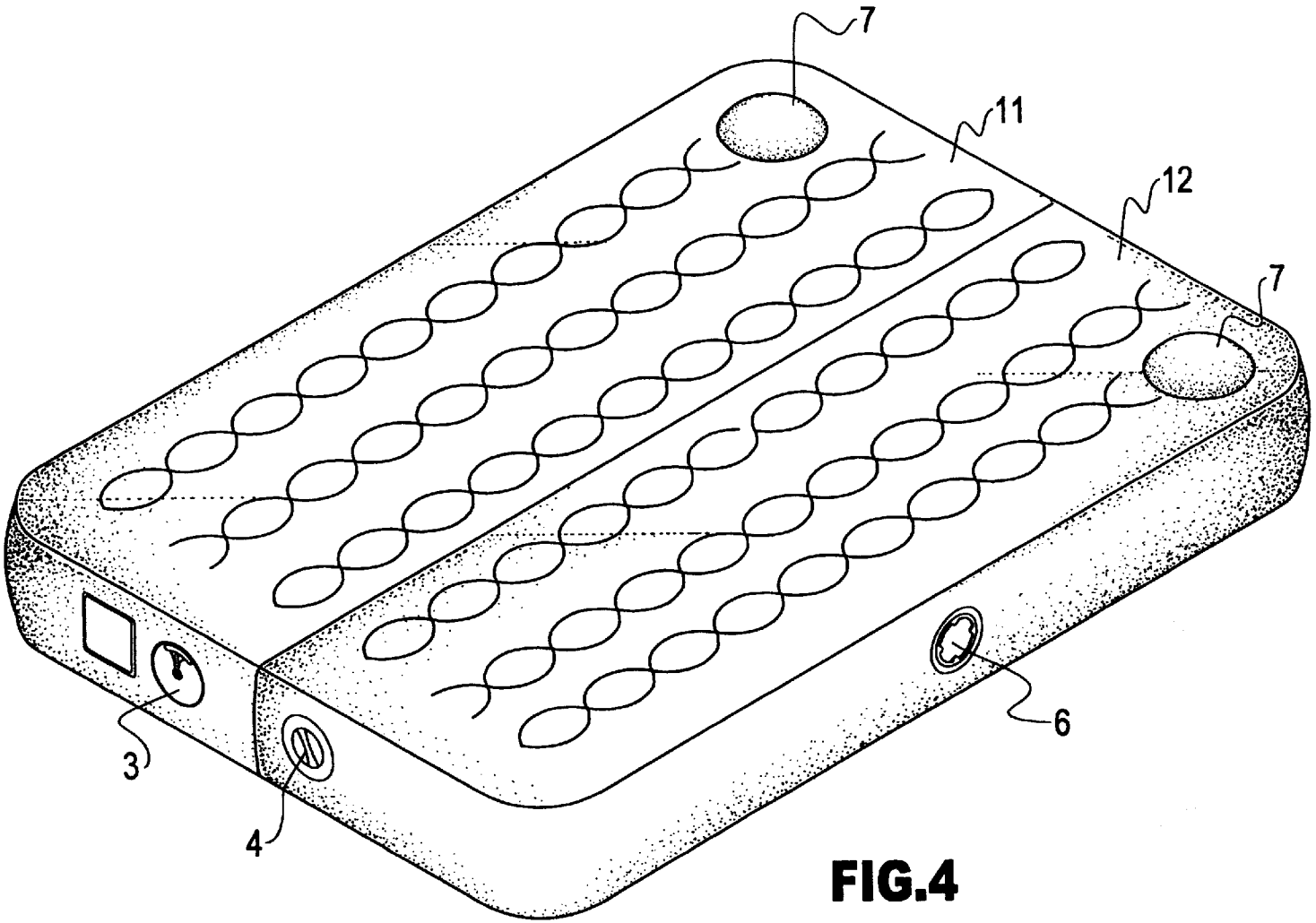
FIG. 4 is a schematic view showing the air bed of the present invention.
Figure 5:
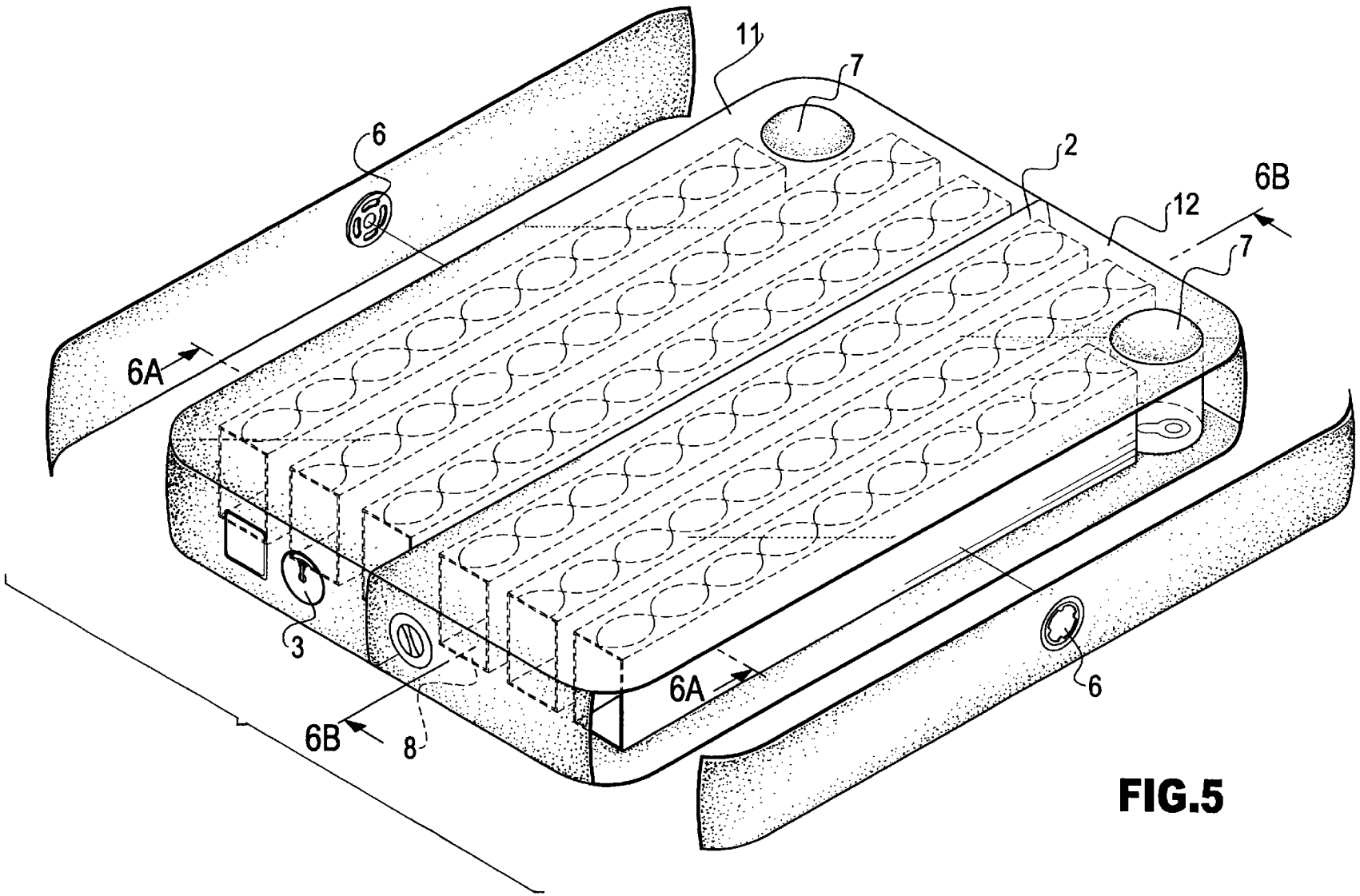
FIG. 5 is a schematic partial perspective exploded view to show the inner structure of the air bed.
Figure 6A:
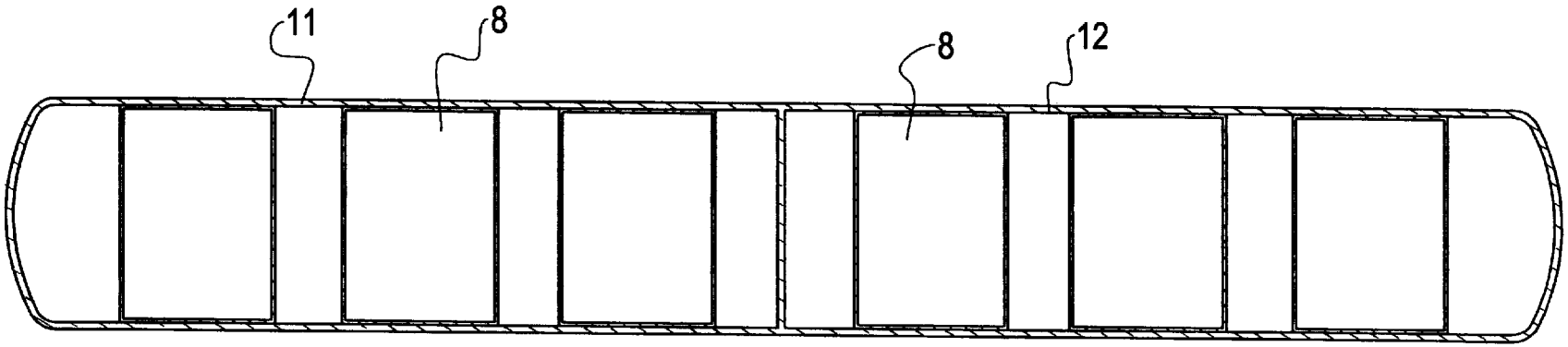
FIGS. 6A and 6B are cross sectional views by taking lines 6A—6A and 6B—6B in FIG. 5 respectively.
Figure 6B:
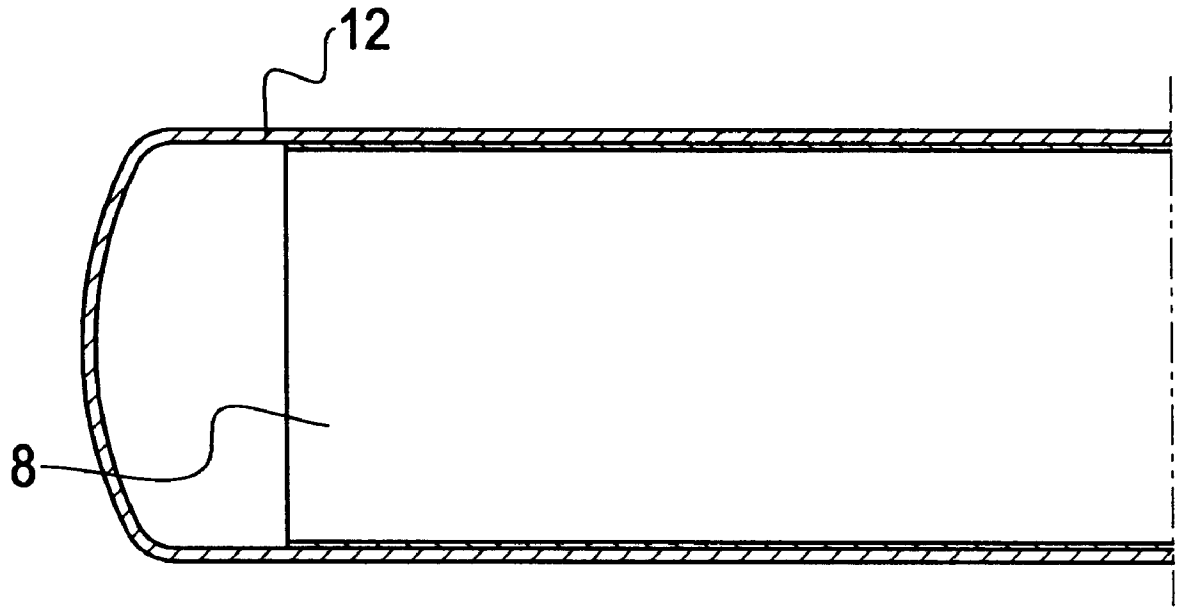

With reference to FIG. 3, an electrical motor (3) is mounted on a side surface of the first chamber (11) for charging and discharging air of the first chamber (11) of the air bed (1). A switch (4) mounted on an outer surface of the second chamber (12) is able to control a control valve (5) which is mounted on the baffle (2) to control communication between the first chamber (11) and the second chamber (12). Thus, when the switch (4) operates the control valve (5) to communicate the first chamber (11) with the second chamber (12), air pumped by the electrical pump (3) is able to flow into the second chamber (12). However, if the switch (4) operates the control valve (5) to close communication between the first chamber (11) and the second chamber (12), the air from the electrical pump (3) will not flow into the second chamber (12). A unidirectional air discharging valve (6) is mounted on the outer surface of each of the first chamber (11) and the second chamber (12) so that either one or both of the first chamber (11) and the second chamber (12) is/are able to discharge air separately or simultaneously.

A foot pump (7) is provided in both the first chamber (11) and the second chamber (12). The foot pump (7) has a hollow cylindrical bellow, an air hole (71) defined to communicate with air outside the air bed (1), a unidirectional membrane (72) mounted on top of the air hole (71) to regulate air inflow from outside the air bed (1) and an outlet (73). Therefore, when the operator repeatedly steps on the bellow, air outside the air bed (1) is sucked in the bellow through the unidirectional membrane (72) and out of the foot pump (7) from the outlet (73) to charge the first chamber (11) and/or the second chamber (12).

With reference to FIGS. 4, 5, 6A and 6B, it is noted that only the baffle (2) engages with opposite inner sides of the air bed (1) to separate the first chamber (11) and the second chamber (12) in an air-tight manner. The other portions inside the air bed (1) are away from engagement with the opposite inner side faces of the air bed (1). Thereafter, when either the electrical pump (3) or the foot pump (7) is activated, the first chamber (11) and/or the second chamber (12) can be charged.

Furthermore, the air bed (1) of the present invention has fixing straps (8) each formed inside the air bed (1) and securely connected to opposite inner side faces of the air bed (1) to maintain the shape of the air bed (1) when the air bed (1) is charged so that deformation of the air bed (1) is prevented.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In an air bed having a hollow body, wherein the improvement comprises:

a baffle is adapted to be provided inside the hollow body to separate the body into a first chamber and a second chamber, the baffle is adapted to engage with inner surfaces of two opposite sides of the body of the air bed, wherein the baffle has a control valve to control communication between the first chamber and the second chamber and a switch mounted on an outer surface of the second chamber to control activation of the control valve so that the communication between the first chamber and the second chamber is able to be controlled by the switch.

2. The air bed as claimed in claim 1, wherein the first chamber has an electrical motor to charge the first chamber with air.

3. The air bed as claimed in claim 2, wherein each of the first chamber and the second chamber has a hollow bellow adapted to be securely mounted inside body, the hollow bellow has an air hole defined to communicate with air outside the body, a unidirectional membrane mounted on top of the air hole to regulate air inflow from outside the body and an outlet selectively communicating with the air hole, such that when air outside the body is sucked in the bellow from the air hole through the unidirectional membrane, the air out of the outlet is able to charge the first chamber and/or the second chamber.

4. The air bed as claimed in claim 3, wherein a unidirectional air discharging valve is mounted on an outer surface of the first chamber and the second chamber so that the first chamber and the second chamber are able to be discharged separately or simultaneously.

5. The air bed as claimed in claim 1, wherein a unidirectional air discharging valve is mounted on an outer surface of the first chamber and the second chamber so that the first chamber and the second chamber are able to be discharged separately or simultaneously.

6. The air bed as claimed in claim 1, wherein straps are adapted to be provided inside the hollow body to prevent the hollow body from deformation when charging.

* * * * *